United States Patent [19]

Jennings

[11] 4,312,320

[45] Jan. 26, 1982

[54] INCINERATOR APPARATUS AND METHOD

[75] Inventor: Charles E. Jennings, Houston, Tex.

[73] Assignee: PA Incorporated, Houston, Tex.

[21] Appl. No.: 160,037

[22] Filed: Jun. 16, 1980

[51] Int. Cl.[3] ..... F24B 5/00; F24B 7/00; F23G 5/04

[52] U.S. Cl. ..... 126/79; 237/55; 110/224; 165/DIG. 2; 165/DIG. 12

[58] Field of Search ..... 126/79; 165/DIG. 2; 237/55; 110/224

[56] References Cited

U.S. PATENT DOCUMENTS

| | | | |
|---|---|---|---|
| 782,508 | 2/1905 | Kelly | 126/79 |
| 1,636,958 | 7/1927 | Harter | 165/DIG. 2 |
| 2,026,969 | 1/1936 | Flynn | 110/224 |
| 3,340,830 | 9/1967 | Frey et al. | 110/224 |
| 3,572,665 | 3/1971 | Vincent | 110/224 |
| 4,044,950 | 8/1977 | Engeling et al. | 237/55 |
| 4,079,888 | 3/1978 | Briscoe | 237/55 |

*Primary Examiner*—Samuel Scott
*Assistant Examiner*—Wesley S. Ratliff, Jr.
*Attorney, Agent, or Firm*—William C. Norvell, Jr.

[57] ABSTRACT

An apparatus and method are provided for removing deposits from material such as drill pipe by subjecting such material to extremely high temperatures in a flame fired furnace. Heated air passing over the material carries with it the volatized deposits and is recirculated within the furnace. As the deposit laden air is recirculated to the burner, the deposits are burned in the flame, thus substantially eliminating the exhaust of contaminants into the surrounding atmosphere.

13 Claims, 5 Drawing Figures

INCINERATOR APPARATUS AND METHOD

BACKGROUND OF THE INVENTION

1. Field of the Invention

The invention relates to an incinerator apparatus and method.

2. Description of the Prior Art

The conflicting requirements of energy conservation and a clean environment have wrought significant changes in industry within the last decade, particularly in the area of incineration and waste disposal. Material which was destroyed or prepared for reuse by fire or treatment at elevated temperatures in the past, now must undergo environmentally innocuous processes that are often more costly than the material destroyed or reclaimed. The increasing cost of energy has further aggravated this problem.

In the well drilling industry, these difficulties manifest themselves in a process utilized to remove deposits from lengths of drilling pipe, tubing, and the like. After extended use, deposits of drilling mud, oil, grease and other material gradually accumulate on the interior and exterior walls of the drilling pipe. Removal of residue and deposits is generally accomplished by subjecting the drilling pipes to elevated temperatures which volatizes or burns off these deposits. This volatization and incineration of drilling pipes deposits produces large quantities of contaminants and particulate laden air which has rendered this process incompatible with contemporary air quality standards.

It is known in the incinerator art that air laden with smoke and particulate contaminants may be effectively clarified by providing for the combustion of said contaminants. For example, such air may be passed into a gasfired combustion chamber wherein such contaminants are burned. The exhaust air from such a combustion device will be substantially free of atmospheric pollutants.

Such exhaust air treatment unfortunately provides an answer to one problem while creating a second of equally timely importance. The energy utilized to provide combustion of the exhaust contaminants and the release of immense quantities of air heated to combustion temperatures into the atmosphere is totally at odds with current energy conversation goals.

SUMMARY OF THE INVENTION

The instant apparatus comprehends an incinerator apparatus and method of operating same which cleans equipment such as drilling pipe of accumulated deposits. Heated, particulate-laden air is recirculated within the incinerator apparatus and the exhaust therefrom is substantially particulate free.

The incinerator apparatus has an elongate chamber within which large quantities of drilling pipes or other equipment may be loaded by suitable means such as carriages or rail cars. A closed air circuit includes an open flame combustion device preferably utilizing natural gas or propane as fuel wherein air is recirculated around the drilling tubes and combustion device. Only sufficient quantities of fresh, combustion air are added to the recirculating air to support combustion and an offsetting volume of air is withdrawn and the recirculating air as exhaust air. The exhaust is passed through a counterflow heat exchanger prior to release into the atmosphere and provides preheating to the fresh, combustion air which replaces it. Specially formed louvers on the outlet side of the treatment chamber direct particulate matter into a lower recirculation duct and away from the exhaust duct to promote not only combustion of said particulate matter but also to achieve the cleanest possible exhaust air.

During set up of the incinerator apparatus, and prior to any substantial volatization of deposits from the drilling pipe, an upper recirculation duct is open to provide recirculation for the air of highest temperature. As the incinerator apparatus and specifically the temperature of the equipment to be cleaned rises, the upper recirculation duct is closed and the lower recirculation duct is opened to achieve combustion of the maximum quantity of particulate matter and smoke as described above.

Thus, it is an object of the instant invention to provide an incinerator apparatus for the cleaning and treatment of large quantities of material such as drilling pipe.

It is a further object of the invention to provide an incinerator apparatus for the cleaning of drilling pipe which exhausts substantially clean, particulate free air into the atmosphere.

It is a still further object of the invention to provide an incinerator apparatus for the treatment of drilling pipe which is both energy efficient and environmentally safe.

It is a still further object of the instant invention to provide a method of operating an incinerator apparatus for the cleaning of material at elevated temperatures.

Further objects and advantages of the instant invention will become apparent by reference to the following description of the preferred embodiment and appended drawings.

DESCRIPTION OF THE PREFERRED EMBODIMENTS

Figure 1:
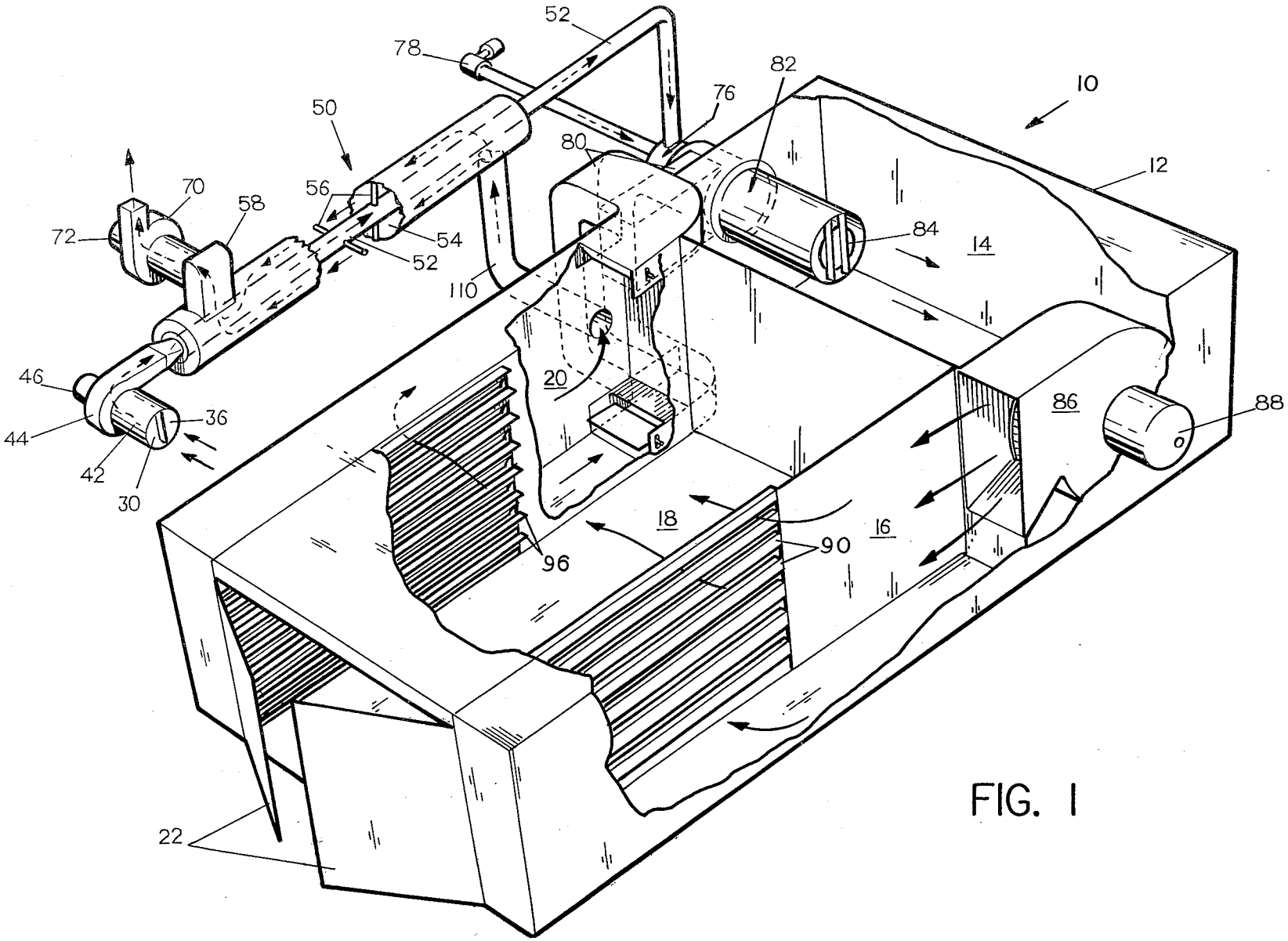
FIG. 1 is a perspective view in partial section of an incinerator apparatus incorporating the instant invention.

Referring now to FIG. 1, an incinerator apparatus incorporating the instant invention is generally designated by the reference numeral 10. The incinerator apparatus 10 includes a generally rectangular compartmentalized housing 12. The housing 12 may be fabricated of material such as suitably welded or secured steel plates capable of withstanding extremely high temperatures. The rectangular housing 12 defines four chambers: a first, heat mixing chamber 14, a second, pressurized chamber 16, a third, treatment chamber 18 and a fourth, vacuum chamber 20. At one end of the housing 12, a pair of suitably hinged doors 22 provides selective access to the treatment chamber 18 and permits the loading and unloading of plural sections of drill pipe or other component devices to be cleaned in the chamber 18.

Figure 2:
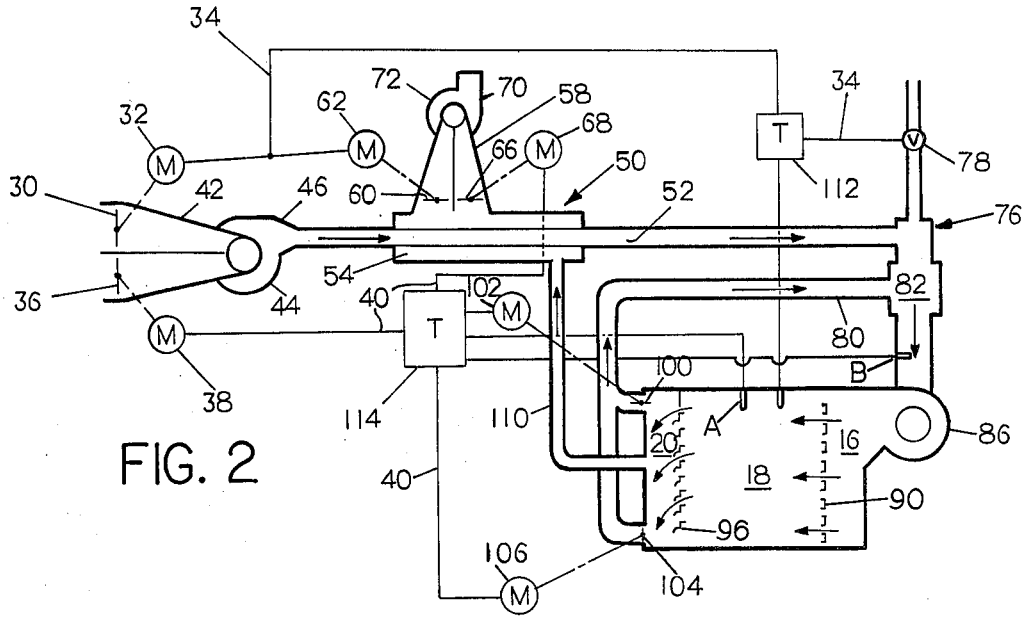
FIG. 2 is a schematic diagram of an incinerator apparatus incorporating the instant invention.

Referring now to FIGS. 1 and 2, the incinerator apparatus 10 includes a primary combustion air damper 30 which is positioned by a modulating motor actuator 32. The motor actuator 32 adjusts the position of the primary combustion air damper 30 between fully opened and fully closed in response to a modulating signal in the control circuit 34. A secondary combustion air damper 36 is disposed adjacent the primary combustion air damper 30 and is controlled by a two position motor actuator 38. The two position motor actuator 38 drives the secondary combustion air damper 36 to either a fully open or fully closed position in response to an appropriate signal in a second control circuit 40. The primary combustion air damper 30 and the secondary combustion air damper 36 are both housed within an inlet duct 42 which is in communication with the inlet side of a combustion air blower 44. The combustion air blower 44 includes a suitable drive means such as an electric motor 46 which provides motive energy to move the air into a counterflow heat exchanger assembly 50.

The counterflow heat exchanger assembly 50 includes an inner conduit or duct 52 which is concentrically supported within an outer conduit or duct 54 by a plurality of radially extending struts 56. In addition to providing mechanical support for the inner duct 52, the struts 56 function as heat transfer devices to improve the flow of heat from the exhaust air in the outer duct 54 to the inlet air in the inner duct 52. The counterflow heat exchanger assembly 50 further includes an exhaust duct 58 in communication with the outer duct 54 within which is disposed a primary exhaust damper 60. The primary exhaust damper 60 is driven by a modulating motor actuator 62 which positions the primary exhaust air damper in any position between fully closed and fully closed. The motor actuator 62 is driven by the signal in the first control circuit 34. The exhaust duct 58 further includes a secondary exhaust air damper 66 which is driven by a two position motor actuator 68. The two position motor actuator 68 selectively positions the secondary exhaust air damper 66 in either the fully open or fully closed position in response to the signal in the second control circuit 40. The exhaust duct 58 is in communication with an exhaust blower 70 which is driven by a suitable electric motor 72.

The air passing through the inner duct 52 of the heat exchanger assembly 50 is then conducted to a gas burner assembly 76. The gas burner assembly 76 includes suitable ignition and flame detection means (not illustrated) and preferably utilizes either propane or natural gas fuel. The burner assembly 76 may be like or similar to those assemblies manufactured by the Eclipse Fuel Engineering Company of Rockford, Ill. The control of gas fuel to burner assembly 76 is achieved by a modulating gas valve 78 which is under the direct control of the signal in the first control circuit 34. The burner assembly 78 also receives contaminant laden gases from the treatment chamber 18 in a recirculation duct 80 which are mixed with the burning gas in a combustion chamber 82. Residence time within the combustion chamber 82 is increased by means of a circular baffle 84 disposed across the outlet opening of the combustion chamber 82. Heated combustion and recirculated air passes through the first, heat mixing chamber 14 and is then drawn into a main blower 86. The main blower 86 is conventional in design and is driven by a prime mover such as an electric motor 88.

Air exits the blower 86 and is supplied to the second, chamber 16. The inner wall of the second, pressurized chamber 16 includes a plurality of inlet louvers 90.

Figure 5:
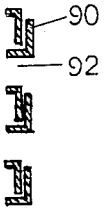
FIG. 5 is an enlarged, sectional end view of a portion of the inlet louvers of an incinerator apparatus incorporating the instant invention.

As illustrated in FIG. 5, the outlet louvers 90 define a plurality of perferably equally spaced horizontal slots 92 which evenly distribute the heated air over the width and height of the inner wall of the second, pressurized chamber 16. The heated air is thus distributed across the length and height of the third, treatment chamber 18 uniformly heating and burning off deposits and residue of the equipment disposed therein. On the opposite wall of the third, treatment chamber 18 from the outlet louvers 90 are a plurality of outlet louvers 96.

Figure 4:
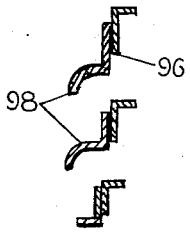
FIG. 4 is an enlarged, sectional end view of a portion of the outlet louvers of an incinerator apparatus incorporating the instant invention.

As illustrated in FIG. 4, the outlet louvers 96 include arcuate baffle portions 98 on all of the louvers 96 except those closest to the bottom of the chamber which are generally right angular. The arcuate portions 98 of the louvers 96 direct the air exiting the third, treatment chamber 18 and entering the fourth, vacuum chamber 20 generally downwardly towards the bottom of the chamber 20. The arcuate baffle portions 98 may define other profiles having a comparable function, i.e. redirecting the flow of heated air from the horizontal to vertically downward. The lowermost louvers 96, typically two in number, direct the air substantially horizontally into the chamber 20.

Figure 3:
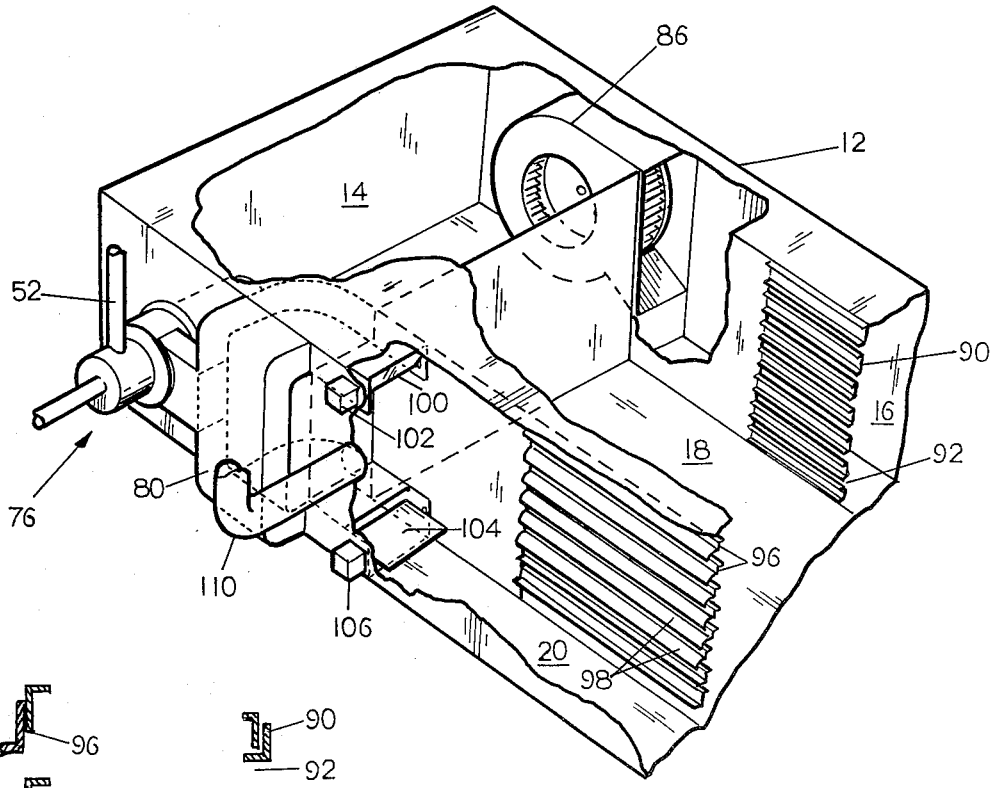
FIG. 3 is a perspective view in partial section of the back side of an incinerator apparatus incorporating the instant invention.

Referring now to FIGS. 2 and 3, air is pulled into and exits the fourth, vacuum chamber 20 by various routes. At the top of the vacuum chamber 20 is an upper damper 100 which is positioned either at a fully open or fully closed position by a two position motor actuator 102. The upper damper 100 controls the flow of air that is pulled from the upper region of the fourth, vacuum chamber 20 into the recirculation duct 80. The two position motor actuator 102 is controlled inversely by the signal in the second control circuit 40, i.e. when the state of the signal in the circuit 40 causes the motor actuators 38 and 68 to open the dampers 36 and 66, respectively, the motor actuator 102 closes the upper damper 100 and the actuator 102 will remain closed throughout the cycle, but the actuator 38 and 68 modulate to the thermocouple B of the circuit 40. Thermocouple A activates the damper 100 to closed position at a set temperature point, and also, at such point, activates thermocouple B. At the bottom of the outlet chamber 20, is a lower damper 104 which is positioned either at a fully open or a fully closed position by a modulating motor actuator 106. The lower damper 104 controls the flow of air from the lower region of the fourth, vacuum chamber 20 into the recirculation duct 80. The modulating motor actuator 106 is controlled directly by the signal in the second control circuit 40 by thermocouple B in order to hold the temperature as high above a predetermined temperature, such as above 140° F., and preferably above 2100° F. An exhaust duct 110 communicates between the fourth, vacuum chamber 20 and the outer duct 54 of the counterflow heat exchanger assembly 50. The opening to the exhaust duct 110 is disposed generally midway between the upper damper 100 and the lower damper 104 on the outer wall of the chamber 20.

The apparatus 10 finally includes suitable temperature sensing and control devices to provide the signals in the first control circuit 34 and the second control circuit 40. As will be apparent to those skilled in the temperature control art, the signal in the first control circuit 34 is a modulating or proportional control signal which may be supplied directly by a suitable modulating thermostat 112 which senses temperature in the third chamber 18. Similarly, the signal in the second control circuit 40 is an on-off i.e., two position signal which is indicative of temperatures within the third chamber 18 being above or below a particular set point typically 500° Fahrenheit. A suitable two position thermostat 114 may be utilized to provide the signal in the second control circuit 40. It should be appreciated that a unitary temperature control device having both on-off and modulating outputs adjusted to various set points and modulation band widths may also be utilized to provide the control signals in the circuits 34 and 40.

OPERATION

Subsequent to the placement of a batch of material such as drilling pipe to be cleaned within the treatment chamber 18, the doors 22 are closed, the three blower motors 46, 72, and 88 are activated in the primary combustion air damper 30 as well as the primary exhaust damper 60 are open for several minutes for a purge cycle. The purge cycle is necessary to ensure removal of all combustible gasses from the apparatus 10 prior to ignition of the burner assembly 76. The dampers 30 and 60 are then left open the gas valve 78 is opened partially and the ignition apparatus is activated in order to establish a flame within the combustion chamber 82 of the burner assembly 76. At this time, the upper damper 100 is open and the bottom damper 104 is closed. With the establishment of combustion within the burner assembly 76, the signal in the first control circuit 34 causes the primary combustion air damper 30, the gas valve 78 and the primary exhaust damper 60 to remain open. The temperature within the incinerator apparatus 10 thus begins to rise. The rapid temperature increase assisted by the fact that air, along with carbon monoxide, which is passing through the recirculation duct 80, is drawn from the upper portion of the fourth, vacuum chamber 20 where it is at the highest temperature. When the thermocouple A senses a temperature of approximately 500°, the output in the second control circuit 40 shifts states and the secondary combustion air damper 36, the secondary exhaust damper 66 and the lower damper 104 opens and the upper damper 102 closes. The temperature within the incinerator 10 and specifically within the combustion chamber 82 thus continues to rise to the region of 2100° Fahrenheit wherein the modulating thermocouple B adjusts the position of the primary combustion air damper 30, the primary exhaust damper 60 and the modulating gas valve 78 to maintain the desired temperature until the treatment of the drilling pipe or other material is completed. With the lower damper 104 open and the upper damper 100 closed, the action of the outlet louvers 96 and specifically the arcuate portion 98 is significant. The arcuate portions 98 of the louvers 96 direct the air exiting the third, treatment chamber 18 which is laden with burned and volatized particulate matter from the treated material downwardly. The inertia of the particulate matter causes it to continue in its downward trajectory, pass around the lower damper 104 and into the recirculation duct 80 to be incinerated in the combustion chamber 82. Exhaust air that is relatively free of such particulate matter exits the fourth, outlet chamber 20 through the exhaust duct 110, the heat exchanger assembly 50 and the exhaust blower 70. It has been found that the temperature of the air passing through the inner duct 52 of the heat exchanger assembly 50 may be raised by approximately 500° Fahrenheit. Recirculation of air from the treatment chamber 18 which is laden with smoke and heavy particulate matter results in the incineration of such particulate matter within the combustion chamber 82 and the exhaust of air through the exhaust duct 110 which is substantially free of such particulate matter. Exhaust gasses which are nearly colorless and odorless pass into the atmosphere through the exhaust blower 70.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An incinerator apparatus comprising, in combination: an inlet duct having at least two independently positionable damper means for controlling the flow of air through said inlet duct; an outlet duct having at least two independently positionable damper means for controlling the flow of air through said outlet duct; heat exchanger means for transferring heat from such air passing through said outlet duct to such air passing through said inlet duct; combustion means in communication with said inlet duct for heating such air in said inlet duct; a treatment chamber in communication with said combustion means, said treatment chamber having a plurality of outlet louvers for directing such air exiting said treatment chamber in a downward direction; a bifurcated recirculation means defining an upper and lower inlet in communication with said treatment chamber for recirculating a portion of such air exiting said treatment chamber to said combustion means; and inlet means in communication with said outlet duct for receiving the remaining portion of such air exiting said treatment chamber.

2. The incinerator apparatus of claim 1 wherein said independently positionable damper means are disposed in parallel in said ducts.

3. The incinerator apparatus of claim 1 wherein said upper inlet has an upper damper disposed thereacross and said lower inlet has a lower damper disposed thereacross.

4. The incinerator apparatus of claim 3 further comprising means for driving one of said upper and lower dampers to an open position while driving the other of said dampers to a closed position and vice versa.

5. An incinerator apparatus comprising, in combination: an inlet duct having means for controlling the flow of air therethrough; an outlet duct having means for controlling the flow of air therethrough; heat exchanger means for transferring heat from such air passing through said outlet duct to such air passing through said inlet duct; a flame fired combustion device in communication with said inlet duct; a treatment chamber in communication with said combustion device; an outlet chamber in communication with said treatment chamber; a plurality of louver means disposed between said treatment chamber and said outlet chamber for directing a flow of air toward the bottom of said outlet chamber; a bifurcated recirculation duct communicating between the upper and the lower regions of said outlet chamber and said combustion device; and an exhaust opening communicating between a central region of said outlet chamber, said heat exchanger and said outlet duct.

6. The apparatus of claim 5 further including means for opening the upper portion of said recirculation duct while closing the lower portion of said duct and vice versa.

7. The apparatus of claim 5 wherein said means for controlling the flow of air through said inlet duct and said outlet duct includes a pair of independently positionable dampers disposed in parallel within said ducts.

8. A method of operating an incinerator apparatus comprising the steps of:

providing a flame fired heating device;

providing a treatment chamber within which material may be placed;

supplying heated air to such treatment chamber from such heating device;

providing an outlet chamber generally adjacent such treatment chamber;

directing such heated air downwardly as it passes from such treatment chamber to such outlet chamber; and providing a first recirculation duct at the bottom of said outlet chamber in communication with such heating device, an exhaust duct above such first recirculation duct and a second recirculation duct at the top of said outlet chamber in communication with such heating device, whereby particulate matter is recirculated to such heating device and air relatively free of particulate matter is moved out through such exhaust duct.

9. The method of claim 8 further comprising the step of withdrawing heat from such air moving through such exhaust duct and providing it to air supplied to such heating device.

10. The method of claim 8 further comprising providing means to open such second duct while closing such first duct and close such second duct while opening such first duct.

11. An incinerator apparatus comprising, in combination: inlet means defining an intake passage having at least two independently positionable damper means for controlling the flow of air through said inlet means, outlet means defining an exhaust passage having at least two independently positionable damper means for controlling the flow of air through said outlet means, heat exchanger means for providing thermal communication between the flows of air in said inlet means and said outlet means, a flame fired combustion device in communication with said inlet means, a treatment chamber in communication with said combustion device, an outlet chamber in communication with said treatment chamber, louver means disposed between said treatment chamber and said outlet chamber for directing air flow toward the bottom of said outlet chamber, a recirculation means defining a passage having a first, upper inlet and a second, lower inlet for providing a return flow of air to said combustion device and an opening in said outlet chamber in communication with said outlet means.

12. The incineration apparatus of claim 11 wherein said first, upper inlet and said second, lower inlet each have a damper disposed thereacross.

13. The incinerator apparatus of claim 12 further including means for driving one of said dampers to an open position while driving the other of said dampers to a closed position and vice versa.

* * * * *